US006831669B2

(12) United States Patent
Miyazawa et al.

(10) Patent No.: US 6,831,669 B2
(45) Date of Patent: Dec. 14, 2004

(54) HEAT SUBLIMATIC PRINTER

(75) Inventors: Azuma Miyazawa, Mitaka (JP); Ryuji Hirata, Hachioji (JP)

(73) Assignee: Olympus Corporation (JP)

( * ) Notice: Subject to any disclaimer, the term of this patent is extended or adjusted under 35 U.S.C. 154(b) by 0 days.

(21) Appl. No.: 10/020,001

(22) Filed: Dec. 7, 2001

(65) Prior Publication Data

US 2004/0046856 A1 Mar. 11, 2004

(30) Foreign Application Priority Data

Dec. 12, 2000 (JP) ..... 2000-378009

(51) Int. Cl.[7] ..... B41J 2/325
(52) U.S. Cl. ..... 347/222
(58) Field of Search ..... 347/209, 211, 347/171; 710/303; 307/18

(56) References Cited

U.S. PATENT DOCUMENTS 5,838,142 A * 11/1998 Wyss et al. ..... 320/148
6,624,834 B2 * 9/2003 Takahashi ..... 347/171
6,629,182 B1 * 9/2003 Mizoguchi et al. ..... 710/303
2003/0085621 A1 * 5/2003 Potega ..... 307/18

FOREIGN PATENT DOCUMENTS

JP 8-310021 11/1996

* cited by examiner

*Primary Examiner*—K. Feggins
(74) *Attorney, Agent, or Firm*—Straub & Pokotylo; John C. Pokotylo

(57) ABSTRACT

A heat sublimable printer in which the present invention is implemented consists mainly of a battery, a thermal head, and a control circuit. The battery offers a rated voltage of 14.8 V and is freely attached or detached to or from a housing of the heat sublimatic printer. The thermal head is incorporated in the housing, provided with a plurality of heating elements whose resistances range from 2800 Ω to 3160 Ω, and used to print an image on paper according to image data. The control circuit that is incorporated in the housing applies a supply voltage developed from the battery to the thermal head without boosting it, and controls the timing of electrically conducting the thermal head.

15 Claims, 3 Drawing Sheets

HEAT SUBLIMATIC PRINTER

This application claims benefit of Japanese Application No. 2000-378009 filed in Japan on Dec. 12, 2000, the contents of which are incorporated by this reference.

BACKGROUND OF THE INVENTION

1. Field of the Invention

The present invention relates to a heat sublimatic thermal transfer printer.

2. Description of the Related Art

In recent years, heat-sensitive heat transfer printers have become popular as devices for producing hardcopies of an image received from a personal computer, a camera-inclusive video tape recorder, an electronic still camera, or the like. The heat-sensitive heat transfer printers can reproduce high-definition images owing to the ability to deal with all colors. This type of conventional printer includes the one disclosed in Japanese Unexamined Patent Publication No. 8-310021 (hereinafter referred to as literature 1).

In the conventional heat-sensitive thermal transfer printer, print paper is pressed against and sandwiched between a platen roller and a thermal head together with an ink sheet. The ink sheet has heat sublimable dyes applied over a base film, and is positioned so that the heat sublimable dyes will stick to the print paper. A plurality of heating elements are arranged on one side of the thermal head. When the thermal head is electrically conducted, the heating elements generate heat according to printing data. Consequently, the heat sublimable dyes are heated through the base film, and then sublimated and transferred to the print paper. Printing is thus achieved.

Incidentally, the printing density on print paper is determined by the temperature of the heating elements. In other words, by changing an amount of current to be supplied to the heating elements of the thermal head, the printing density can be changed readily. As a method of changing an amount of current to be delivered to the heating elements, a method of changing a time during which a current is delivered to the heating elements (hereinafter, referred to as a conduction time) is adopted.

By extending the conduction time during which a current is delivered to the heating elements, the density for photo-printing can be raised. However, when the conduction time during which a current is delivered to the heating elements is extended, the time required for printing increases. In particular, as far as a color printer is concerned, printing must be performed four times using, for example, four inks of yellow (Y), magenta (M), cyan (C), and black (BK) as heat sublimable dyes. The extension of the conduction time therefore invites a great increase in the printing time.

In order to shorten the conduction time without narrowing the range of densities for photo-printing, a voltage to be applied to the thermal head is usually set to be relatively high. For example, a conventionally widely adopted voltage to be applied to the thermal head ranges from 22 V to 28 V.

In recent years, various pieces of equipment have come to be portable. The portable equipment is demanded to be more and more compact. The trend to a compact design does not make printers an exception. In order to realize a portable printer, a battery must be used as a power supply.

On the other hand, various types of batteries are known as batteries for portable equipment. In recent years, a lithium-ion secondary cell has been widely adopted because its battery capacity is improved to be large and it is easier to use. Currently, a lithium-ion cell whose rated output voltage is 3.6 V, 3.7 V, or 3.8 V is widely known to suit portable equipment. Assume that this type of lithium-ion cell is used to realize a power supply of a portable printer like the aforesaid one. In this case, since the printer is portable equipment, as long as the number of lithium-ion cells loaded in the printer is four or so, the printer would be realized as a printer whose size satisfies the condition that the printer should be portable. In this case, if four lithium-ion cells whose rated output voltage is 3.6 V, 3.7 V or 3.8 V are juxtaposed, a supply voltage of 14.4 V, 14.8 V, or 15.2 V is developed.

However, conventionally, the portable printer using a thermal head is, as mentioned above, designed on the assumption that a battery is adopted. Moreover, the portable printer requires a supply voltage of approximately 30 V for the purpose of shortening the conduction time. In other words, if the voltage developed from a battery loaded in equipment is 14.4 V, 14.8 V, or 15.2 V, the voltage must be boosted to approximately 30 V.

FIG. 3 is a block diagram showing a power feed circuit for the aforesaid type of thermal head. Referring to FIG. 3, a direct current (dc) power supply 2 develops a power supply voltage of, for example, 14.4 V, 14.8 V, or 15.2 V. The power supply voltage is applied to a DC-DC converter 1 and boosted to approximately 30 V. The voltage boosted by the DC-DC converter 1 is applied to the heating elements of the thermal head through a terminal 3.

As mentioned above, as far as the conventional portable heat sublimatic printer is concerned, the DC-DC converter is adopted for developing a required power supply voltage. However, the DC-DC converter for boosting a dc voltage of 14.4 V, 14.8 V, or 15.2 V into approximately 30 V is very large in size. This poses a problem in that the printer gets large in size. Moreover, the DC-DC converter causes significant power loss. This leads to an increase in power consumption required by a battery. It is therefore impossible to keep driving equipment employing the DC-DC converter for a prolonged period of time.

The literature 1 has proposed that a battery are incorporated as a power supply, and disclosed that a nickel-cadmium cell capable of developing 14.4 V is adopted as the battery. However, the proposal has a drawback that it takes much time to achieve printing as mentioned previously. Moreover, no mention is made of the structure of a thermal head and a control sequence that are suitable for a compact printer and that help improve the performance of the printer. The aforesaid problems are left unsolved.

OBJECT AND SUMMARY OF THE INVENTION

An object of the present invention is to provide a heat sublimatic printer capable of being designed compactly without the necessity of extending a conduction time by optimizing a supply voltage and resistances offered by heating elements.

Briefly, according to the present invention, there is provided a heat sublimatic printer consisting mainly of:

- a battery whose rated voltage is 14.8 V and that is freely attached or detached to or from a housing of the heat sublimatic printer;
- a thermal head incorporated in the housing, provided with a plurality of heating elements whose resistances range from 2800 Ω to 3160 Ω, and used to print an image on paper according to image data; and
- a control circuit, incorporated in the housing, for applying a supply voltage developed from the battery to the thermal head without boosting it, and controlling the timing of electrically conducting the thermal head.

These objects and advantages of the present invention will become further apparent from the following detailed explanation.

DETAILED DESCRIPTION OF THE PREFERRED EMBODIMENTS

Figure 1:
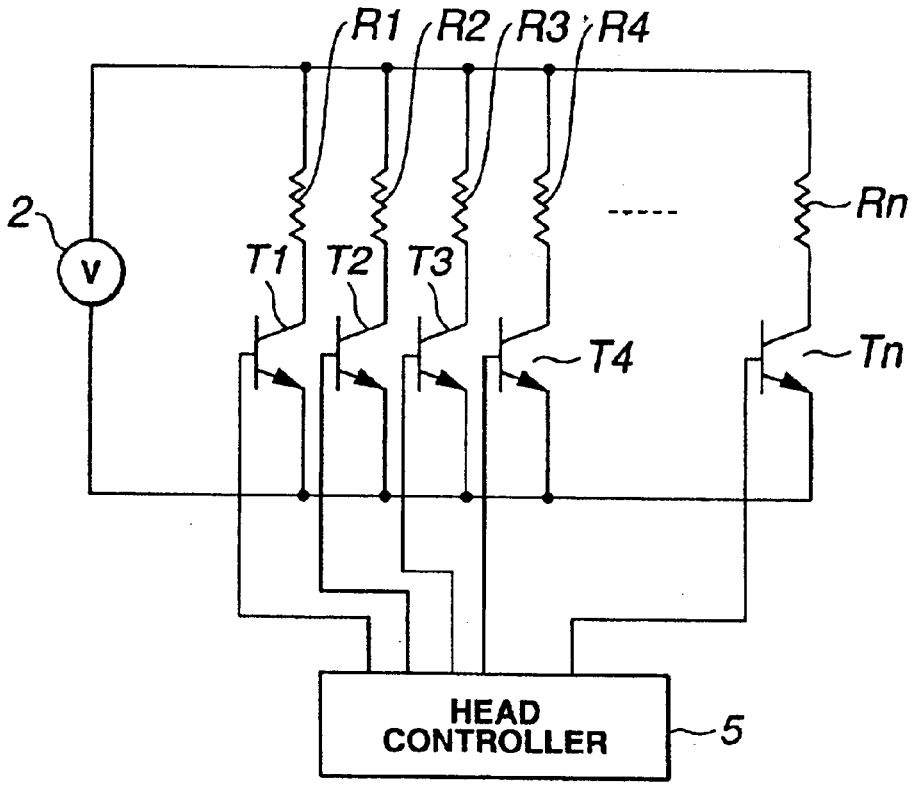
FIG. 1 is a circuit diagram showing a thermal head drive unit included in a heat sublimatic printer in accordance with an embodiment of the present invention.

Referring to the drawings, an embodiment of the present invention will be described below.

FIG. 1 is a circuit diagram showing a thermal head drive unit included in a heat sublimatic printer in accordance with an embodiment of the present invention.

Figure 2:
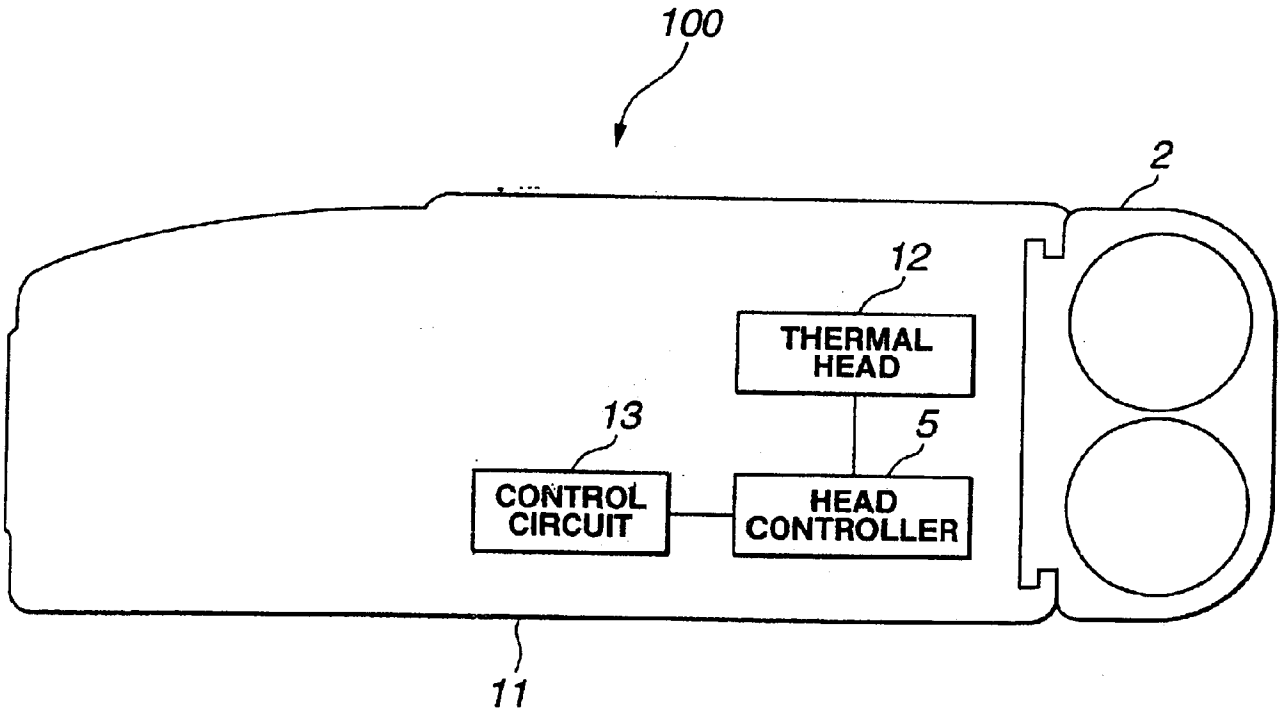
FIG. 2 shows a housing and a battery of the heat sublimatic printer in accordance with the embodiment.
Figure 3:
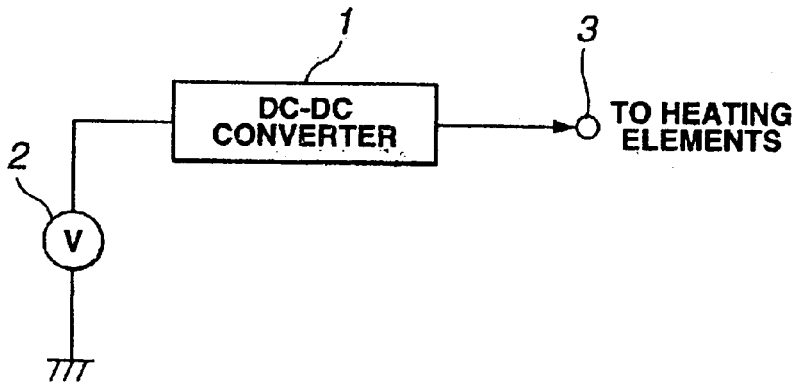
FIG. 3 is a circuit diagram showing an example of a power feed circuit for a thermal head adopted in a conventional heat sublimatic printer.

FIG. 2 shows a housing of the heat sublimatic printer in accordance with the present embodiment and a battery thereof freely attached or detached to or from the housing.

As shown in FIG. 2, a heat sublimatic printer 100 in accordance with the present embodiment consists mainly of a housing 11 and a battery 2. The housing 11 accommodates at least a thermal head 12, a head controller 5, and a control circuit 13 for controlling the head controller 5 and others. The battery 2 is freely attached or detached to or from the housing 11.

Referring to FIG. 1, heating elements R1, R2, etc., and Rn (hereinafter, generically, R) serve as dot locations on the thermal head 12. During printing, the thermal head clamps print paper and an ink sheet that are not shown, and is pressed against a platen roller that is not shown. The heating elements R are fixed to the thermal head and pressed against the print paper with the ink sheet between them.

The heating elements R1 to Rn have one terminals thereof connected to a positive-polarity terminal of a power supply 2, and have the other terminals thereof connected to collectors of transistors T1 to Tn. Emitters of transistors T1 to Tn connected to a negative-polarity terminal of a power supply 2. When the heating elements R1 to Rn are electrically conducted, the heating elements R1 to Rn generate heat to heat heat sublimable dyes on the ink sheet. Consequently, the heat sublimable dyes are sublimated and then transferred to print paper.

The transistors T1 to Tn function as switches for controlling electric current conduction of the heating elements R1 to Rn. The transistors T1 to Tn have bases thereof connected to the head controller 5. The head controller 5 controls the on-off operations of the transistors T1 to Tn according to printing data. The transistors T1 to Tn are turned on with a high-level electric conduction control signal applied to the bases thereof by the head controller 5. This causes the transistors T1 to Tn to deliver a current fed from the power supply 2 to resistors R1 to Rn. With a low-level electric conduction control signal applied, the transistors are turned off to discontinue current feed to the resistors R1 to Rn. Thus, the head controller 5 controls electric current conduction of each of the heating elements R1 to Rn serving as the dot locations.

According to the present embodiment, a supply voltage developed from the power supply 2 is set to 14.8 V, and the resistances of the heating elements R1 to Rn range from 2800 Ω to 3160 Ω. According to the present embodiment, the power supply 2 and heating elements R1 to Rn are designed as mentioned above. Alternatively, the power supply 2 and heating elements R1 to Rn may be designed as described below. Namely, the supply voltage developed from the power supply 2 may be 15.2 V and the resistances offered by the heating elements R1 to Rn may range from 2950 Ω to 3340 Ω. Otherwise, the supply voltage developed from the power supply 2 may be 14.4 V and the resistances offered by the heating elements R1 to Rn may range from 2650 Ω to 2990 Ω.

Important factors in designing a printer are what a maximum density E (which will be described later) to be attained for photo-printing should be and how long a conduction time during which a head is electrically conducted should be. The maximum density E is predetermined to be a certain value.

As described previously, when the conduction time t is extended, although the resistances offered by heating elements are small, a satisfactory printing density is attained. However, this leads to a long printing time. As far as a color printer is concerned, a printing operation is performed relative to four inks of, for example, yellow, magenta, cyan, and black. Namely, the printing operation is performed four times. The extension of the conduction time invites a great increase in the printing time. This impairs the practicality of the printer and cannot therefore be adopted. For this reason, according to the present embodiment, an amount of current flowing into the heating elements R is increased in efforts to shorten the conduction time.

According to the present embodiment, a so-called battery is adopted as a power supply of equipment from the viewpoint of portability. In the present embodiment, four lithium-ion cells whose rated voltage is 3.7 V are connected in series with one another in order to realize the power supply 2 whose rated voltage is 14.8 V. Consequently, although the power supply 2 develops a high supply voltage that permits portable use of the printer, the printer can be designed relatively compactly. The portability of the printer can be ensured.

According to the present embodiment, a DC-DC converter is not employed in consideration of portability. In other words, according to the present embodiment, as seen from FIG. 1, a supply voltage developed from the power supply 2 is not boosted but applied to the heating elements R1, R2, etc., and Rn as it is. The resistances offered by the heating elements R1 to Rn are set to appropriate values, and a sufficient current is delivered to the heating elements R. Consequently, photo-printing performed with a conduction time shortened is enabled.

In some of typical heat sublimatic printers characterized by a short conduction time, a resistor offering 7 kΩ is adopted as heating elements and a voltage of 22 V is applied to the heating elements. In other printers, a resistor offering 10 kΩ is adopted as the heating elements and a voltage of 28 V is applied to the heating elements. According to the present embodiment, settings are made so that an amount of energy to be applied to the thermal head will be equal to the one applied in the typical printers characterized by a short conduction time.

The amount of energy to be applied to the thermal head is provided by an expression (1) below.

$$E=KV^2t/R \quad (1)$$

where E denotes an amount of energy permitting printing at a certain photo-printing density, k denotes a thermal efficiency of a head, V denotes a voltage to be applied to the head, R denotes a resistance offered by the head, and t denotes a conduction time during which a current flows into the head.

According to the present invention, heating resistors whose resistances range from 2800 Ω to 3160 Ω that are calculated based on the expression (1) are used as the heating elements to which a voltage of 14.8 V is applied.

In the present embodiment, four lithium-ion cells whose rated voltage is 3.7 V are connected in series with one another in order to realize the power supply 2 whose rated voltage is 14.8 V. As another embodiment, four lithium-ion cells whose rated voltage is 3.6 V or 3.8 V may be connected in series with one another in order to realize the power supply 2 whose rated voltage is 14.4 V or 15.2 V.

In this case, that is, when the power supply 2 is designed to offer a rated voltage of 15.2 V, heating resistors whose resistances range from 2950 Ω to 3340 Ω are used as the heating elements to which the voltage is applied. When the power supply 2 is designed to offer a rated voltage of 14.4 V, heating resistors whose resistances range from 2650 Ω to 2990 Ω are used as the heating elements to which the voltage is applied.

In the present embodiment, the battery having four lithium-ion cells connected in series with one another is adopted as the power supply 2. As shown in FIG. 2, the battery is freely attached or detached to or from the housing 11 in which the thermal head 12, head controller 5, and control circuit 13 are incorporated.

According to the present embodiment, the battery having four lithium-ion cells connected in series with one another is freely attached or detached to or from the housing. The present invention is not limited to this form. Alternatively, the battery may be incorporated in advance in the housing.

Next, movements made in the present embodiment having the aforesaid components will be described below.

The heating elements R1 to Rn of the thermal head are pressed against a platen roller with an ink ribbon and print paper between them. In this state, the head controller 5 transmits an electric conduction control signal to the transistors T1 to Tn to drive the transistors T1 to Tn. Consequently, the heating elements R1 to Rn are electrically conducted.

A supply voltage developed from the power supply 2 is applied to any of the heating elements R1 to Rn connected to transistors that are turned on. Assuming that the supply voltage developed from the power supply 2 is 14.8 V and that the resistances of the heating elements R1 to Rn range from approximately 2800 Ω to 3160 Ω, a sufficient current permitting adoption of a relatively short conduction time flows into the heating elements connected to the transistors that are on.

Consequently, the heat sublimable dyes applied to an ink ribbon are sublimated and transferred to print paper. At this time, the heating elements are heated to the temperature calculated from an amount of current proportional to the conduction time according to the expression (1). The heat sublimable dyes are transferred at a photo-printing density associated with an amount of generated heat.

After a predetermined number of lines extending in the direction of the width of print paper is reproduced by the heating elements, the print paper and ink-ribbon are transported in order to photoprint the predetermined number of succeeding lines. Thereafter, printing by the thermal head and transportation of the print paper and ink ribbon are repeated in order to achieve printing.

When printing of the first color (for example, cyan) is completed, the print paper is transported to the same position as a start position at which printing of the first color is started. Thereafter, the ink ribbon is moved to a position at which the second color ink (for example, yellow) can be transferred. Printing of the second color is achieved in the same manner as that of the first color. Thereafter, likewise, the other colors are photoprinted, and printing is completed.

As mentioned above, according to the present embodiment, the resistances offered by the heating elements range from 2800 Ω to 3160 Ω. Thus, even when the same voltage as the rated voltage of 14.8 V is applied to the heating elements as it is, a sufficient amount of current can be fed. Consequently, photo-printing is enabled without the necessity of extending a conduction time. Otherwise, the resistances offered by the heating elements may range from 2950 Ω to 3340 Ω or from 2650 Ω to 2990 Ω. In this case, even when the supply voltage identical to the rated voltage of 15.2 V or 14.4 V is applied to the heating elements as it is, a sufficient amount of current can be fed. Consequently, photo-printing can be achieved without the necessity of extending the conduction time.

In either of the cases, it is confirmed experimentally that photo-printing is achieved optimally. As for a conduction time, that is, a total printing time, high-speed printing that is satisfactory in practice can be expected.

A battery capable of developing a high supply voltage that permits portable use and being structured compactly can be adopted as the power supply 2. This leads to excellent portability. Occurrence of significant power loss derived from employment of a DC-DC converter, occupation of a very large space by the heavy DC-DC-converter, and heat dissipation due to use of the DC-DC converter can be avoided. Consequently, a high-speed printer having excellent portability can be realized.

As described so far, according to the present embodiment, a supply voltage and resistances offered by heating elements are optimized. Consequently, a compact printer can be realized without the necessity of extending a conduction time.

In this invention, it is apparent that working modes different in a wide range can be formed on this basis of this invention without departing from the spirit and scope of the invention. This invention is not restricted by any specific embodiment except being limited by the appended claims.

What is claimed is:

1. A heat sublimatic printer comprising:

a battery whose rated voltage is 14.4 V;

a thermal head provided with a plurality of heating elements whose resistances range from 2650 Ω to 2990 Ω, and used to print an image on paper according to image data; and a control circuit for applying a supply voltage developed from said battery to said thermal head without boosting it, and controlling the timing of electrically conducting said thermal head.

2. The heat sublimatic printer according to claim 1, wherein said battery has four lithium-ion secondary cells connected in series with one another.

3. A heat sublimatic printer comprising:

a battery whose rated voltage is 14.8 V;

a thermal head provided with a plurality of heating elements whose resistances range from 2800 Ω to 3160 Ω, and used to print an image on paper according to image data; and a control circuit for applying a supply voltage developed from said battery to said thermal head without boosting it, and controlling the timing of electrically conducting said thermal head.

4. The heat sublimatic printer according to claim 3, wherein said battery has four lithium-ion secondary cells connected in series with one another.

5. A heat sublimatic printer comprising:

a battery whose rated voltage is 15.2 V;

a thermal head provided with a plurality of heating elements whose resistances range from 2950 Ω to 3340 Ω, and used to print an image on paper according to image data; and a control circuit for applying a supply voltage developed from said battery to said thermal head without boosting it, and controlling the timing of electrically conducting said thermal head.

6. The heat sublimatic printer according to claim 5, wherein said battery has four lithium-ion secondary cells connected in series with one another.

7. A heat sublimatic printer comprising:

a battery offering a rated voltage of 14.4 V and being freely attachable or detachable to or from a housing of said heat sublimatic printer;

a thermal head incorporated in said housing, provided with a plurality of heating elements whose resistances range from 2650 Ω to 2990 Ω, and used to print an image on paper according to image data;

a control circuit, incorporated in said housing, for applying a supply voltage developed from said battery to said thermal head without boosting it, and controlling the timing of electrically conducting said thermal head.

8. The heat sublimatic printer according to claim 7, wherein said battery has four lithium-ion secondary cells connected in series with one another.

9. A heat sublimatic printer comprising:

a battery offering a rated voltage of 14.8 V and being freely attachable or detachable to or from a housing of said heat sublimatic printer;

a thermal head incorporated in said housing, provided with a plurality of heating elements whose resistances range from 2800 Ω to 3160 Ω, and used to print an image on paper according to image data;

a control circuit, incorporated in said housing, for applying a supply voltage developed from said battery to said thermal head without boosting it, and controlling the timing of electrically conducting said thermal head.

10. The heat sublimatic printer according to claim 9, wherein said battery has tour lithium-ion secondary cells connected in series with one another.

11. A heat sublimatic printer comprising:

a battery offering a rated voltage of 15.2 V and being freely attachable or detachable to or from a housing of said heat sublimatic printer;

a thermal head incorporated in said housing, provided with a plurality of heating elements whose resistances range from 2950 Ω to 3340 Ω, and used to print an image on paper according to image data;

a control circuit, incorporated in said housing, for applying a supply voltage developed from said battery to said thermal head without boosting it, and controlling the timing of electrically conducting said thermal head.

12. The heat sublimatic printer according to claim 11, wherein said battery has four lithium-ion secondary cells connected in series with one another.

13. A heat sublimatic printer comprising:

a thermal head provided with a plurality of heating elements whose resistances range from 2650 Ω to 2990 Ω, and used to print an image on paper according to image data; and a control circuit for applying a supply voltage developed from a battery to said thermal head without boosting it, and controlling the timing of electrically conducting said thermal head.

14. A heat sublimatic printer comprising:

a thermal head provided with a plurality of heating elements whose resistances range from 2800 Ω to 3160 Ω, and used to print an image on paper according to image data; and a control circuit for applying a supply voltage developed from a battery to said thermal head without boosting it, and controlling the timing of electrically conducting said thermal head.

15. A heat sublimatic printer comprising:

a thermal head provided with a plurality of heating elements whose resistances range from 2950 Ω to 3340 Ω, and used to print an image on paper according to image data; and a control circuit for applying a supply voltage developed from a battery to said thermal head without boosting it, and controlling the timing of electrically conducting said thermal head.

* * * * *